United States Patent [19]

Anderson et al.

[11] 4,162,746

[45] Jul. 31, 1979

[54] LIQUID DISPENSER LOCKING MEANS

[75] Inventors: Walter F. Anderson, West Covina; Ronald A. Meyer, San Dimas, both of Calif.

[73] Assignee: Diamond International Corporation, New York, N.Y.

[21] Appl. No.: 809,008

[22] Filed: Jun. 22, 1977

[51] Int. Cl.[2] ..... B65D 47/34

[52] U.S. Cl. ..... 222/153; 222/321; 222/384

[58] Field of Search ..... 222/153, 384, 402.11, 222/321

[56] References Cited

U.S. PATENT DOCUMENTS

| | | | |
|---|---|---|---|
| 3,422,996 | 1/1969 | Lipman | 222/402.11 |
| 3,474,939 | 10/1969 | O'Donnell et al. | 222/402.11 X |
| 3,489,322 | 1/1970 | Ayres | 222/384 X |
| 3,590,691 | 7/1971 | Magers | 222/153 X |
| 3,669,295 | 6/1972 | Horvath | 215/9 |
| 3,797,705 | 3/1974 | Cooprider | 222/153 |
| 3,827,605 | 8/1974 | Knickerbocker | 222/153 |
| 3,949,906 | 4/1976 | Pettersen et al. | 222/153 |

*Primary Examiner*—Robert J. Spar
*Assistant Examiner*—Frederick R. Handren
*Attorney, Agent, or Firm*—Watson, Cole, Grindle & Watson

[57] ABSTRACT

A liquid dispenser has relatively rotatable closure, sleeve and plunger members, the latter two being locked against reciprocation of the plunger member by a misalignment between ribs and grooves therebetween. One of the grooves has a pair of upstanding pegs on opposite sides so as to not only avoid inadvertent alignment when the ribs and grooves are in a misaligned position, but to also permit the plunger and sleeve members to rotate together as the rib abuts against one or the other of the pegs when in a misaligned position. A spacer element surrounding the plunger rod maintains the inlet valve in a closed position despite a slight separation between the plunger and sleeve members when rotated to the misaligned position. Also, the closure member is adapted to be removed only with difficulty from the container on which it is affixed.

13 Claims, 7 Drawing Figures

LIQUID DISPENSER LOCKING MEANS

BACKGROUND OF THE INVENTION

Various means have in the past been used to lock the reciprocable plunger of a hand-help pump dispenser when not in use. Usually the plunger and an adjoining member are relatively rotated between operative and inoperative positions of the plunger, as for example shown in U.S. Pat. Nos. 3,797,705 and 3,827,605, commonly owned herewith. Such relative rotation may move ribs and grooves between the parts into and out of alignment with one another so as to respectively permit reciprocation of the plunger and to lock the plunger in its raised position. U.S. Pat. Nos. 3,590,691; 3,422,996 and 3,489,322 illustrate such a locking means. However, it has been found that the ribs and grooves have a tendency to inadvertently align themselves especially if the dispenser is tampered with or dropped thereby defeating the purpose for which the locked dispenser is intended, i.e., a child-resistant and safety pump dispenser. When in the hands of children, the rotatable parts of these pump dispensers are capable of being easily manipulated to a point where the ribs and grooves will eventually become aligned into an operable position of the plunger. Moreover, the container closure member utilized for mounting the pump dispenser to a container is typically, in prior art designs, threadedly engageable with the container so as to be easily manipulated for removal. These and other aspects of the prior art arrangements detract from their effectiveness as a safety or child-resistant dispenser actuator.

SUMMARY OF THE INVENTION

It is therefore an object of the present invention to provide a locking means for a liquid dispenser of the mating rib and groove type between adjoining rotatable parts for effectively locking the plunger of the dispenser in a manner whereby the safety and child-resistant features thereof are vastly improved in a simple and economical manner.

Broadly speaking, such a liquid dispenser includes three parts which are each relatively rotatable — a plunger, a locking member and a container closure member. Alignable ribs and grooves on the plunger and locking member effect a locking of the plunger against reciprocation upon relative rotation of the parts into a misalignment between the ribs and grooves, and permit depression of the plunger upon relative rotation of the parts into alignment between the ribs and grooves. Means are provided for preventing inadvertent re-alignment of the ribs and grooves when misaligned, such means also permitting the two parts to be rotated together when in a plunger-locked position. Also, when in such a plunger-locked position, the three-piece assembly becomes partially disassembled yet the inlet valve remains fully seated thereby avoiding any tendency of leakage through the inlet due to creep or deformation of the valve. And, the container closure member is designed to be either fixedly secured to the container or to be of a two-part slip clutch construction so as to avoid easy access to the container therethrough.

More specifically, the locking member according to the invention includes a rotatable sleeve having a transverse wall with at least one groove therein flanked on opposite sides by short upstanding pegs so as to require the exertion of force in misaligning a rib on the plunger with such groove during relative rotation of the plunger and sleeve. In such a misaligned position the plunger and sleeve may then be rotated together as the rib bears against an outer side of one of the pegs while in the locked plunger position. To this end the pegs are designed as lying in the path of rotation of the rib, and a third peg may be provided on the transverse wall of the sleeve opposite the pair of pegs and likewise lying in a path of rotation of the rib thereby serving as a further stop as the rib bears thereagainst in the locked plunger position so as to effect a combined turning of the plunger and sleeve after a half-turn between these parts. A plurality of ribs may be provided on the sleeve respectively for alignment with corresponding grooves provided on the sleeve wall, except that the pegs lie in the path of only one of such ribs to function as aforedescribed.

When rotated into its locked position the plunger is elevated slightly above its raised position during the process of its rib being forced past one of the pegs flanking its mating groove. The plunger is therefore moved slightly away from a spacer element which positions a coil spring which is typically provided for maintaining a ball inlet valve in place, and which is further provided for biasing the plunger to permit reciprocating movement. Nevertheless, the inlet valve remains fully positioned by means of the spacer sleeve which surrounds the plunger rod and which immobilizes the spring as the spacer bears thereagainst as well as against a portion of the container closure member.

DETAILED DESCRIPTION OF THE INVENTION

Figure 1:
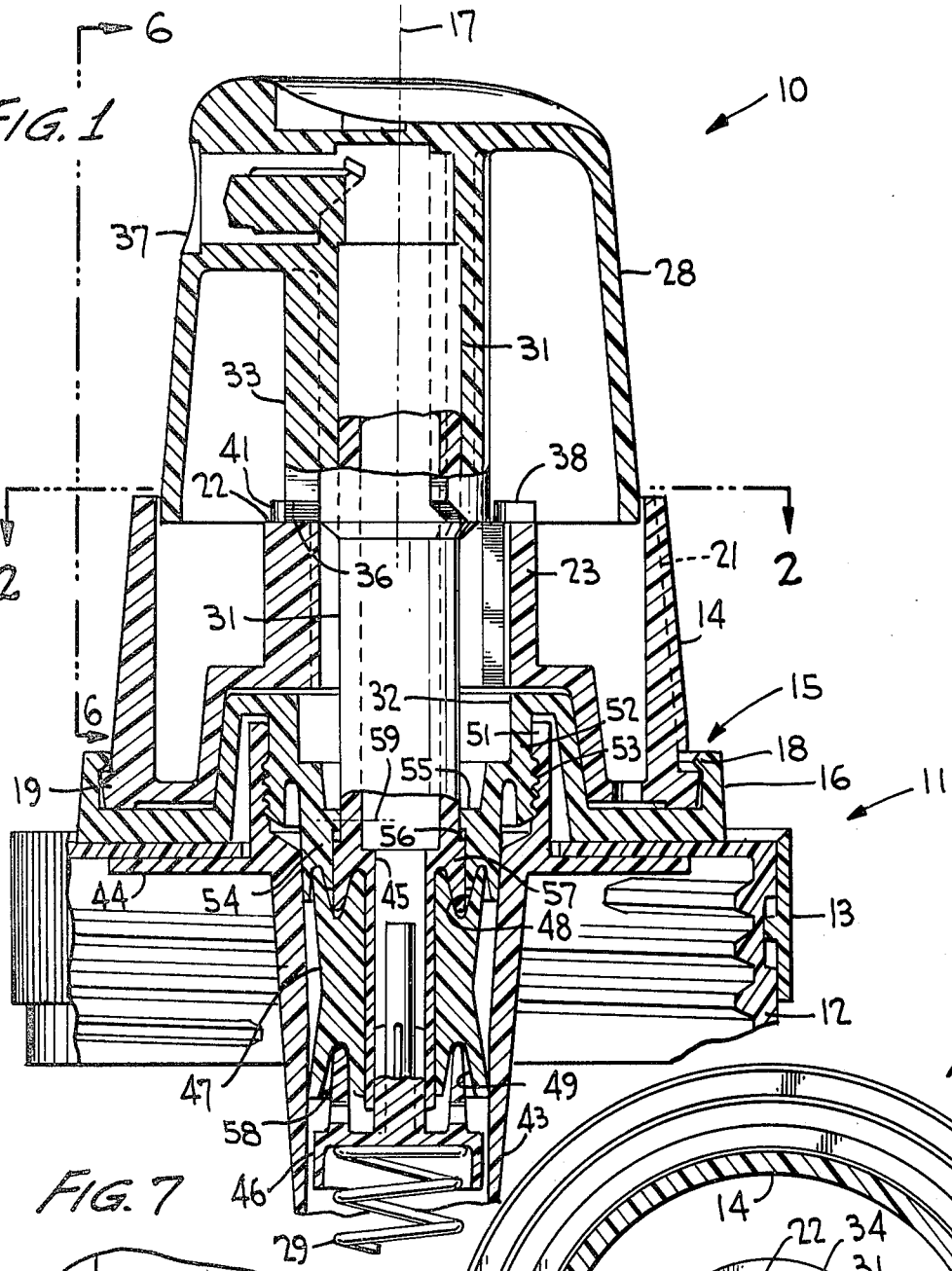
FIG. 1 is an enlarged view in an axial section showing the dispenser assembly according to the invention adapted for use with a liquid container, the plunger being shown in its raised and locked position.
Figure 3:
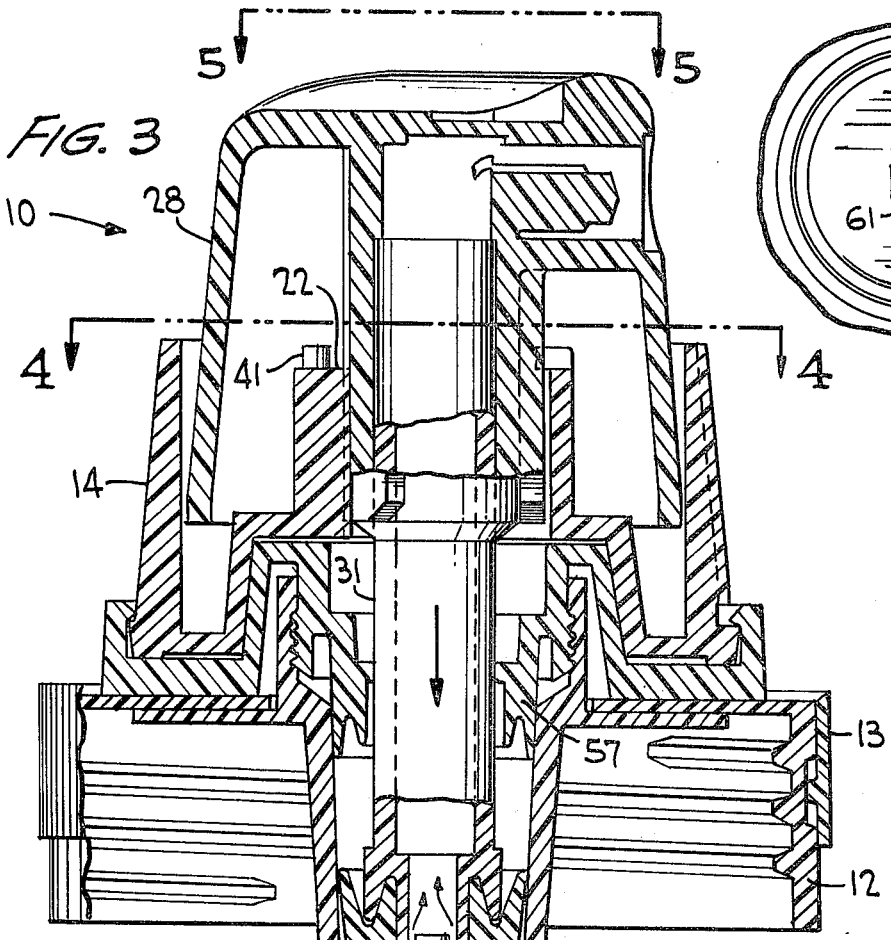
FIG. 3 is a view similar to FIG. 2 except that the plunger is shown in its operative position in the process of reciprocation during pumping.
Figure 5:
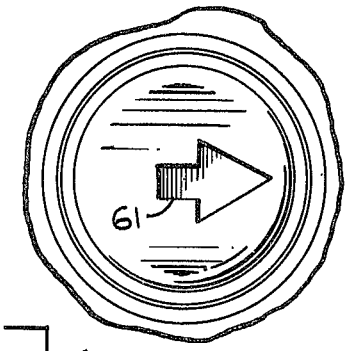
FIG. 5 is a top plan view of the plunger head.

Turning now to the drawings wherein like reference characters refer to like and corresponding parts throughout the several views, the dispensing means of the invention is generally designated 10 in FIGS. 1 and 3 and comprises a dispensing pump mountable on a container (not shown) filled with liquid to be dispensed selectively by reciprocation of the dispensing pump plunger.

The dispenser includes a container closure member generally designated 11 which may be of a two-part construction comprising an inner part 12 having internal threads adapted for threaded engagement with the outer threads on the container neck, and further comprising an outer ring 13 having a threadless inner surface and being connected to part 12 by means of a slip clutch arrangement causing ring 13 to rotate in both directions relative to part 12 thereby effecting a safety closure for the container. Such a closure is shown in U.S. Pat. No. 3,669,294 and is specifically incorporated herein by reference. As disclosed therein, the closure can be removed only by raising the ring relative to the container and maintaining a firm upward axial pressure while unscrewing part 12. As an alternative, the container closure member may comprise only a ring such as 13 having a threadless inner wall so that it may be fixedly secured as by gluing or the like to the container.

The dispenser further includes a locking member in the form of an annular sleeve 14 connected as at 15 to a part 16 for rotation about central axis 17 relative thereto. Part 16 has an annular bead 18 thereon engageable with an annular shoulder 19 provided on sleeve 14. The sleeve is provided with axial serrations 21 along its outer periphery to facilitate rotative manipulation thereof by the operator. Sleeve 14 is also provided with a transverse wall 22 (see also FIG. 2) at the upper end of an inner annular portion 23 thereof. Wall 22 has a central opening 24 therein interrupted along its inner periphery by a plurality of slots 25, 26 and 27 which are spaced apart unequal distances such that slots 26 and 27 are respectively spaced farther apart from slot 25 than slots 26 and 27 are spaced apart from one another. The function of this particular spacing will be brought out more clearly hereinafter.

Figure 6:
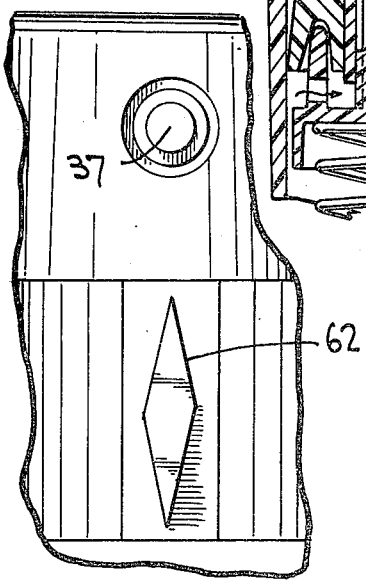
FIG. 6 is an end elevational view of the plunger and locking sleeve taken substantially along line 6—6 of FIG. 1.

The dispenser further includes a plunger member 28 of a typical well known configuration shown in FIG. 1, as disposed in its fully raised position by means of a coil spring 29, at the end of each discharge stroke, whereby it may be operated by intermittent finger pressure on its upper end to dispense the desired amount of product from the container to which closure member 11 and its associated dispensing pump are applied. The plunger member has a plunger rod 31 extending through central opening 24 of the locking sleeve as well as through a central opening 32 provided in part 16. In order to provide for selectively locking pump plunger 28 in its fully raised inoperative position of FIG. 1 during shipment or storage and further to render it substantially child resistant, so as to prevent inadvertent actuation and discharge of product, the present invention makes provision for inclusion in the present pump of a locking arrangement including axially extending ribs 33, 34 and 35 provided on plunger rod 31 at spaced distances apart corresponding to the spacings of slots 25, 26 and 27. The ribs have lower end surfaces 36, as typically shown in FIG. 7, which lie in the same plane as the top surface of wall 22 when the plunger is in its raised position of FIG. 1. Hence, while in this raised position, upon relative rotation between locking sleeve 14 and plunger 28 to a position of FIG. 2 wherein the ribs and the grooves are misaligned, end surfaces 36 will be brought into abutting engagement with the top surface of wall 22 so as to prevent reciprocation of the plunger along central axis 17. On the other hand, relative rotation between sleeve 14 and plunger 28 so as to place the ribs and grooves respectively into alignment as shown in FIG. 4, will permit the plunger to be depressed for pumping the liquid content out of the container through discharge orifice 37 (see also FIG. 6) in the normal manner.

Figure 7:
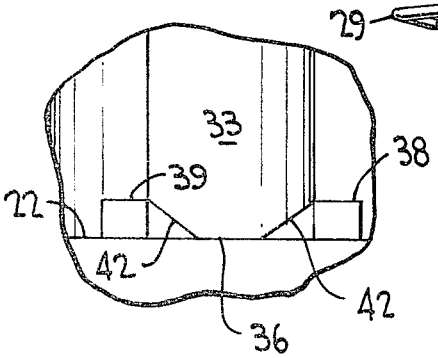
FIG. 7 is a view taken substantially along line 7—7 of FIG. 4 and showing the relationship between a chamfered end surface of a rib and the pair of pegs surrounding its mating groove.
Figure 2:
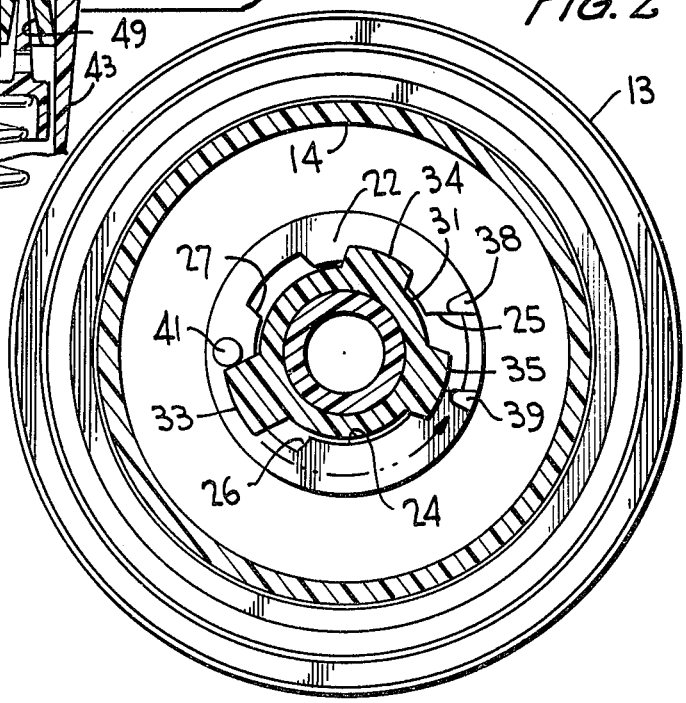
FIG. 2 is a sectional view taken substantially along line 2—2 of FIG. 1 and showing the details of the misaligned ribs and grooves between the plunger and locking sleeve.

In order to prevent inadvertent alignment between the ribs and the grooves when the plunger is in its inoperative position of FIG. 2, a pair of upstanding pegs 38 and 39 are provided on wall 22 and extend a short distance toward the plunger as seen in side elevation in FIG. 7. These pegs flank groove 25 on opposite sides thereof as shown in FIGS. 2 and 4 and lie in the path of rotation of rib 33 as clearly shown in FIG. 4. This rib 33 extends radially outwardly from plunger rod 31 a greater distance as compared to ribs 34 and 35. Another upstanding peg 41 is provided on wall 22 and likewise extends toward the plunger, this peg being located opposite pegs 38 and 39 by approximately 180°. This peg likewise lies in the path of rotation of rib 33, although all three pegs lie out of the path of rotation of ribs 34 and 35 as typically shown in FIG. 2 for rib 35 relative to peg 39. And, each end surface 36 of the ribs is chamfered on opposite sides as at 42 (FIG. 7).

Figure 4:
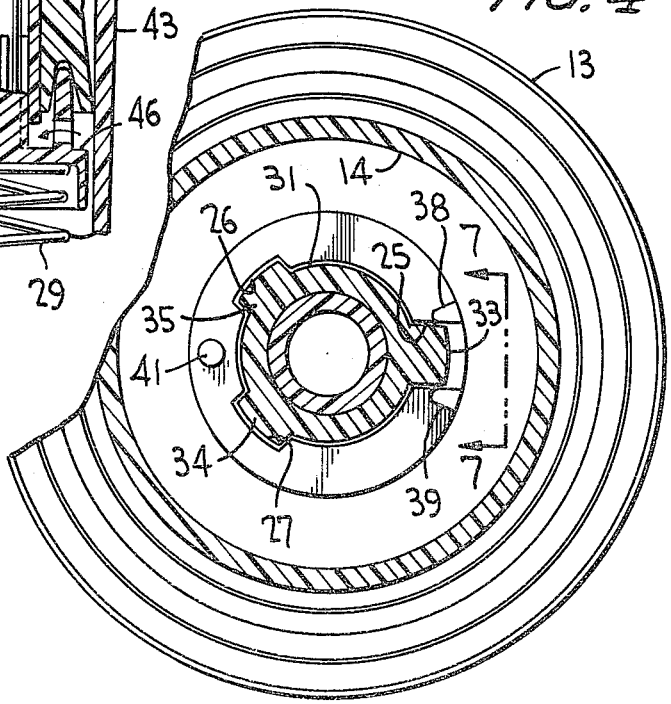
FIG. 4 is a sectional view taken substantially along line 4—4 of FIG. 3 and showing alignment between the ribs and grooves of the plunger and sleeve to permit plunger reciprocation.

Hence, while the plunger is in its fully raised position and in an operative condition of FIG. 4 whereby the ribs and grooves are aligned, relative rotation between the plunger and the locking sleeve will cause rib 33 to be forced past one of the pegs 38, 39 depending on the direction of rotation of the plunger. The chamfered end surface of rib 33 will effect a smoother movement of this rib past one of the pegs 38, 39 but will nevertheless cause a degree of force to be applied while relatively rotating sleeve 14 and plunger 28. With the plunger now in its inoperative position of FIG. 2, shown after having relatively rotated the plunger clockwise, it can be continued to be rotated clockwise relative to sleeve 14 until a side wall of rib 33 abuts against peg 41. Thereafter, continued clockwise rotation of the plunger will cause locking sleeve 14 to rotate therewith. And, counterclockwise rotation of the plunger will bring the opposite side wall of rib 33 into abutting engagement with peg 39 during which time the plunger may be rotated relative to the locking sleeve. However, when rib 33 abuts against peg 39 it will effect a combined rotation of the plunger and the locking sleeve in a counterclockwise direction of FIG. 2 if the locking sleeve is not held. The same principle applies if rib 33 is forced over peg 38. It can be therefore seen that the plunger is permitted its relative rotation through an arc of only approximately 180° whereafter sleeve 14 will begin rotating together therewith in either direction. However, if peg 41 were to be eliminated, the plunger and sleeve could be relatively rotated throughout almost 360° before they begin rotating together as rib 33 abuts against one or the other of pegs 38, 39 depending on the direction of rotation. Also, chamfers 42 on the ribs could be eliminated if so desired.

During relative rotation between plunger 28 and sleeve 14, ribs 34 and 35 bypass each of the upstanding pegs which extend out of the rotational path of these two ribs. These two ribs serve together with rib 33 to act as guides for the plunger during alignment thereof with their respective grooves as shown in FIG. 4. Also, end surfaces 36 of the three unequally spaced ribs, serve to positively support the plunger in its raised and locked position, and the unequal spacing of the ribs as well as the greater radial extent of rib 33 avoids the tendency of rib and groove alignment except between rib 33 and its groove 25 and between the other ribs and their grooves as shown in FIG. 4.

As shown in FIGS. 1 and 3, plunger rod 31 extends into the throat 43 of an element 44 which is fixedly secured to inner part 12 of the container closure member. Of course, if but a single threadless ring were to be used as the closure member so as to be fixedly secured to the container as mentioned above, parts 16 and 44 would be fixedly secured directly thereto. Plunger 31 has a reduced section 45 which surrounds a portion of an end cap 46 in frictional engagement therewith. The lower portion of this end cap receives the upper end of coil spring 29 which, at its lower end, is pressured against a ball inlet valve (not shown) for maintaining it against its valve seat. A spacer element 47 surrounds section 45 of the plunger rod and has annular grooves 48 and 49 at opposite ends. Part 44 has an upstanding annular flange 51 in engagement with a depending annular flange 52 provided on part 16, such engagement which is shown at 53 being in the form of interlocking annular serrations between flanges 51 and 52.

A further annular depending flange 54 extends from flange 52 and has an inwardly extending shoulder 55 thereon. This shoulder acts as a stop for an outwardly extending shoulder 56 provided on an annular extension 57 of the plunger rod. This extension as well as a portion of flange 54 are seated within groove 48 of spacer 47. And, an upwardly extending annular flange 58 of cap 46 is seated within annular groove 49 of the spacer. Hence, spacer element 47 bears against a fixed part 16 while in the upwardly raised position of FIG. 1, and is lowered out of engagement therewith while the plunger is being depressed during a pumping action as shown in FIG. 3. Thus, the spacer provides for exertion of a constant pressure on the inlet valve while the plunger is in its raised position, and even while the plunger is elevated from such raised position as its rib 33 is in the process of being forced past one of the pegs 38, 39. During such a forcing operation while the plunger and sleeve 14 are being relatively rotated, section 45 of the plunger rod is slightly raised relative to spacer 47 and end cap 46 to an elevation shown at approximately line 59. Shoulders 55 and 56 are therefore squeezed together and, because of the resilient nature of the non-metallic material of these parts, the shoulders resiliently yield and thereafter resume their normal shape after rib 33 has cleared one of the pegs 38, 39 so as to return end surfaces 36 into abutting engagement with the top of wall 22 as shown in FIG. 1. This deformation of the shoulders from their squeezed back to their relaxed positions serves to retract the plunger downwardly into intimate contact between surfaces 36 and wall 22 after one of the pegs 38 and 39 is cleared. Of course, the plunger can be completely disassembled and removed by prying it away from sleeve 14 upon the exertion of a sufficient force to cause shoulder 56 to bypass shoulder 55.

In order to insure vertical alignment between rib 33 and its groove 25, indicia is provided on the plunger and the locking sleeve in the form of an arrow 61 on the plunger head which is aligned with orifice 37 and a diamond mark 62 or the like provided on a side wall of sleeve 14. Arrow 61 also informs the operator of the direction in which the fluid will be dispensed through the outlet orifice during the pumping action.

From the foregoing it can be seen that a safety pump dispenser has been provided wherein the plunger may be locked to prevent inadvertent actuation and discharge of product, and will remain locked even when the plunger is rotated as when the dispenser is dropped or is manipulated by a child. In order to misalign the ribs and grooves the plunger and locking sleeve must be relatively rotated so as to force rib 33 past one of the pegs 38, 39 whereafter the locking plunger will continue its rotation until it abuts against peg 41 to thereby cause the plunger and the locking sleeve to rotate together. Such an arrangement, together with the unequal spacing of the ribs and the different radial extent thereof, renders it all the more difficult for a child to appropriately align rib 33 with its groove 25 to place the plunger in an operative position for dispensing. Moreover, the slight disassembly between the parts of the pump during the process of initially misaligning the ribs and grooves, nevertheless allows the inlet valve to remain completely seated by means of spacer element 47 which immobilizes spring 29 while the plunger is elevated from its fully raised position. The inlet valve is thereby rendered more forgiving to creep and deformation.

Obviously, many modifications and variations of the invention are made possible in the light of the above teachings. It is therefore to be understood that within the scope of the appended claims the invention may be practiced otherwise than as specifically described.

What is claimed is:

1. A liquid dispenser, comprising, a container closure member, a locking member mounted on said closure member for rotation about a central axis thereof, a plunger member disposed for reciprocating movement between a lowered position and a spring-biased raised position, said plunger member being rotatable about said central axis and extending through axial openings in said closure and said locking members, said locking member including an annular abutment surrounding said plunger member and extending radially thereof, said plunger member including at least one radially extending rib having a first radial extent and an end surface engageable with said annular abutment for maintaining said plunger member in said raised position, said annular abutment having at least one groove for the reception of said rib upon relative rotation of said locking member and said plunger member thereby permitting said plunger member to be reciprocated to said lowered position, said abutment having a pair of pegs adjacent opposite sides of said groove and another peg spaced from said groove, said pegs extending toward said plunger member with at least portions thereof lying at radial distances from said axis less than said first radial extent of said rib whereby, when said plunger member is locked in said raised position, said plunger member and said locking member are rotatable together in one direction and another as said rib respectively abuts one of said pair of pegs and said another peg, said pair of pegs preventing inadvertent alignment between said rib and said groove so that said plunger member remains in said locked position until said rib is forced past one of said pair of pegs into alignment with said groove upon relative rotation of said plunger member and said locking member.

2. The dispenser according to claim 1, wherein said plunger member has three spaced radially extending ribs each having an end surface in engagement with said annular abutment for maintaining said plunger member in said raised position, one of ribs having said first radial extent and the remaining ribs each having a second radial extent less than the radial extent of said one rib so as to bypass said pegs, and said annular abutment having three spaced grooves complementary to said ribs for the reception thereof upon relative rotation of said locking and plunger members, said remaining ribs bypassing said pegs upon such relative rotation.

3. The dispenser according to claim 1, wherein said closure member has a threadless inner annular surface whereby said closure member may be mounted on a container for non-removal therefrom.

4. The dispenser according to claim 1, wherein said end surface of said rib is chamfered on opposite sides to permit said rib to be more easily forced past said one of said pair of ribs.

5. The dispenser according to claim 1, further including a spring for biasing said plunger during its reciprocating movement, a spacer element disposed between said closure member and said spring, said plunger member bearing against said spacer element for moving same against said spring during reciprocated movement of said plunger member to said lowered position, said plunger member being axially movable relative to said spacer member to permit said rib to be forced past either of said pair of pegs upon relative rotation of said plunger member and said locking member without affecting the bias of the spring.

6. The dispenser according to claim 5, wherein said spacer member comprises a sleeve having groove seats at opposite ends, a cap member being engageable with said plunger member and bearing against said spring, said cap member engaging one of said sleeve seats and a portion of said closure member engaging the other of said sleeve seats.

7. The dispenser according to claim 6, wherein said plunger is likewise engageable with said other sleeve seat for the moving of said sleeve.

8. A liquid dispenser, comprising, a container closure member, a sleeve member rotatable relative to said closure member about a central axis, a plunger member rotatable about said axis relative to both said sleeve member and to said closure member, said plunger member having a plunger rod extending through axial openings in said closure and said sleeve members, said sleeve member having a transverse wall surrounding said rod and having at least one groove on said wall for the reception of at least one rib provided on said rod, a pair of pegs on said wall extending toward said plunger member on opposite sides of said groove and lying in the path of rotational movement of said one rib, said plunger and sleeve members being relatively rotatable into positions of alignment and misalignment between said rib and said groove while said plunger member is in a raised position, said position of alignment permitting said plunger member to be axially reciprocated and said position of misalignment causing said plunger member to be locked in its raised position as an end surface of said rib abuts against said wall, rotation between said positions causing said plunger member to be elevated from its raised position an extent equal to that of said pegs as said end surface is forced past one of said pegs, said rib abutting against said pegs in said position of misalignment whereby said plunger and sleeve members are caused to rotate together while said plunger member is locked, and said pegs prevent inadvertent realignment between said rib and said groove while in said position of misalignment.

9. The dispenser according to claim 8, wherein three spaced radially extending ribs are provided on said rod for the reception within three correspondingly spaced grooves provided in said wall for the reception of said ribs, said one rib having a radial extent greater than that of the remaining pair of said ribs so that said pegs lie in the rotational path of only said one rib.

10. The dispenser according to claim 8, wherein a peg is provided on said wall and extends toward said plunger member, said peg being spaced from said pair of pegs and lying in the rotational path of said rib, whereby said rib abuts against said peg and a first of said pair of pegs in said position of misalignment.

11. The dispenser according to claim 8, further including a coil spring for biasing said plunger during its reciprocating movement, a spacer element surrounding said rod and being disposed between said spring and said closure member for seating said spring, whereby as said plunger member is raised to said extent from said raised position, said rod is accordingly elevated without affecting the seating of said spring.

12. The dispenser according to claim 11, wherein said spacer comprises a sleeve having grooves in opposite end surfaces for engagement respectively with said closure member and with a cap member provided between said plunger member and said spring, said plunger member likewise engaging one of said grooves.

13. The dispenser according to claim 8, wherein said ribs and said corresponding grooves are unequally spaced apart so that, together with different radial extents of said ribs, said ribs and grooves are alignable in only one position of relative rotation between said plunger and said sleeve.

* * * * *